United States Patent [19]

Carter

[11] Patent Number: 4,997,219

[45] Date of Patent: Mar. 5, 1991

[54] MULTI-LOCK LATCH

[76] Inventor: Walter H. Carter, Broseco Ranch Rt. 2 Box 199, Omaha, Tex. 75571

[21] Appl. No.: 552,156

[22] Filed: Jul. 13, 1990

[51] Int. Cl.[5] ..... E05C 1/16

[52] U.S. Cl. ..... 292/153; 292/148; 70/121

[58] Field of Search ..... 70/14, 101, 121, DIG. 63; 292/148, 153, 210, 205, 104, 108

[56] References Cited

U.S. PATENT DOCUMENTS

| | | | |
|---|---|---|---|
| 1,260,469 | 3/1918 | Smith | 292/153 |
| 2,586,900 | 2/1952 | Alderman | 292/153 X |
| 2,707,125 | 4/1955 | Ritter, Sr. | 292/148 X |
| 2,780,383 | 2/1957 | Coit, Jr. | 292/153 X |
| 2,856,220 | 10/1958 | Easley | 292/148 |
| 3,752,518 | 8/1973 | Cannell | 292/148 X |
| 3,889,497 | 6/1975 | Tuttle | 70/14 |
| 3,988,031 | 10/1976 | Meyer | 292/148 X |
| 4,240,278 | 12/1980 | Linder | 70/101 |
| 4,697,443 | 10/1987 | Hillin | 70/121 |

FOREIGN PATENT DOCUMENTS

| | | | |
|---|---|---|---|
| 1476884 | 3/1967 | France | 70/DIG. 63 |

*Primary Examiner*—Richard E. Moore
*Attorney, Agent, or Firm*—John M. Harrison

[57] ABSTRACT

A multi-lock latch for gates and other closures which utilizes one or more padlocks for security and includes a drum rotatably attached to the gate and having a peripheral flange provided with multiple, spaced padlock openings for receiving the respective padlock shackles. A horizontally-oriented locking bar is slidably attached to the gate, with one end of the locking bar positioned in alignment with the respective shackle openings in the drum flange as the drum is rotated, and the opposite, or locking end of the locking bar aligned with a plate opening provided in a gate post plate mounted on a gate post securing the gate. When the padlocks are attached to the drum flange by insertion of the respective shackles through corresponding shackle openings in the drum flange, the locking bar is disposed such that the locking end is inserted in the plate opening located in the gate post plate and the gate cannot be opened. However, when one of the padlock shackles is removed from a corresponding shackle opening in the drum flange, the drum and remaining padlocks may be rotated to align this opening with the locking bar and the locking bar then slidably adjusted, to extend through the opening vacated by the shackle, remove the opposite end of the locking bar from the plate opening and allow the gate to open.

20 Claims, 1 Drawing Sheet

MULTI-LOCK LATCH

BACKGROUND OF THE INVENTION

1. Field of the Invention

This invention relates to locking systems for gates and other closures and more particularly, to a multi-lock latch, which utilizes multiple padlocks to facilitate gate entry by as many persons. The multi-lock latch is characterized by a drum rotatably secured to the gate and provided with a peripheral flange having spaced padlock shackle openings for receiving the padlock shackles in locked configuration. A locking bar is horizontally mounted in sliding relationship on the gate, such that a drum-engaging end of the locking bar is aligned with the shackle openings as the drum is rotated and the opposite, or locking end of the padlock is aligned with a plate opening located in a gate post plate mounted on a gate post securing the gate. Accordingly, the gate is locked and cannot be opened when the locking bar is disposed such that the locking end thereof is inserted in the plate opening located in the gate post plate and the drum-engaging end is spaced from the drum. However, the gate may be opened by unlocking one of the padlocks, removing the padlock shackle from the corresponding shackle opening, rotating the drum and remaining padlocks to align the shackle opening and the drum-engaging end of the locking bar and sliding the locking bar horizontally, such that the drum-engaging end extends through the vacant shackle opening. This movement of the locking bar causes the locking end of the locking bar to vacate the plate opening in the gate post plate and allows the gate to open. It will be appreciated that this same procedure may be followed by unlocking each of the other padlocks attached to the drum flange, to facilitate access through the gate by multiple individuals, each having a key or the combination to one of the respective padlocks, as the case may be.

One of the problems which is realized in the locking of gates which block access to such properties as oil and gas leases, ranches and other areas which require access by more than one person, is that of providing a separate key for each person. A typical locking device for such gates is a chain wrapped around the gate post and gate, which chain is secured by a single padlock to prohibit unauthorized ingress. Since keys are easily lost and it is difficult and time-consuming to distribute new keys in such an event, or when a new padlock is required due to weathering or damage to the old one, a continuing problem of ingress and egress exists when several persons must enter the premises.

2. Description of the Prior Art

U.S. Pat. No. 2,707,125, dated Apr. 26, 1955 to J. W. Ritter, Sr., details a "Means for Locking a Gate to a Gatepost". The Ritter patent discloses vertically movable members which are each secured by a padlock and when unlocked, are adapted to slide in a gate post for lifting and lowering a gate latch slide bolt and opening and closing the gate, respectively. U.S. Pat. No. 3,889,497, dated June 17, 1975, to Herman I. Tuttle, details a "Multiple-Lock Securing System". The multiple-lock securing system includes a bar having a security device attached thereto. A locking plate contains openings with locks positioned therein and the bar can be fastened to the locking plate when the locks are positioned in each of the openings. When one of the locks is removed from the locking plate the bar is released, providing access to the secured area. A "Multiple Padlock Device" is detailed in U.S. Pat. No. 3,988,031, dated Oct. 26, 1976, to Gordon R. Meyer. The multiple padlock device includes a vertically-rotatable plate mounted on a stationary, horizontal axis in the same plane as the fence and gate when the gate is closed. A series of holes are located in the rotatable plate, with individual bars pivotally attached to the plate to cover each respective hole. Locking holes are contained in both the rotatable plate and each pivotable bar contained thereon, to lock the bar into a position covering each of the respective holes. A horizontally slidable locking bar, which is in the same plane as the gates, slidably extends through a gate post, with one end thereof extending into a hole in the fence post. The other end of the locking bar is in abutting relationship with the rotatable plate, such that if a pivotal bar is moved to one side, the horizontal slidable locking bar may be extended through a hole in the rotatable plate, thereby removing the opposite end from the hole in the fence post to allow the gate to be opened. U.S. Pat. No. 4,240,278, dated Dec. 23, 1980, to Peter J. Linder, details a "Gate Locking Device". The device includes a locking mechanism for a horizontally swinging gate bar to lock the end of the bar to a vertical post. The vertical post has a cap member threadably mounted eccentrically thereon, the cap member having a cavity to receive the end of the gate bar. The cap member contains a locked linkage, one of the links of which includes a locking projection engaging a slot in the post. The linkage includes pivotal connections formed by the shackles of padlocks. By removing at least one of the padlocks, the linkage can be disconnected to allow withdrawal of the locking projection from the post slot and allow the cap member to be rotated sufficiently to enable the end of the gate bar to be swung out of the locking cavity. A stop member depending from the floor of the cavity cooperates with a horizontal lug in the post to prevent unscrewing of the cap member from the post. A "Multi-Lock Security Device" is detailed in U.S. Pat. No. 4,697,443, dated Oct. 6, 1987, to Wilbert L. Hillin. The device includes a locking plate rotatably disposed on a stationary axis, the axis secured to an existing structure or embedded in the ground. The locking plate is provided with a series of radial access channels formed through a flange retaining rib disposed on the lock plate, to enable the gate pin to be slidably held within an interior latch race. Fastening gates are pivotally attached to the locking plate and may be closed across the access channels and secured with padlocks connectable through corresponding openings in both the fastening gate and the locking plate.

It is an object of this invention to provide a multi-lock latch which operates to facilitate ingress and egress by multiple individuals using multiple padlocks.

Another object of the invention is to provide a multi-lock latch which is designed to facilitate ingress and egress through a gate by using multiple padlocks mounted in locking openings on a rotatable drum flange, wherein one end of a cooperating, sliding locking bar may be slidably inserted in a selected one of the locking openings when a padlock is removed, to facilitate removal of the opposite end of the locking bar from a gate post and opening the gate.

Another object of this invention is to provide a multi-lock latch for closing a gate, which latch is characterized by a rotating drum provided with a peripheral flange having spaced openings therein for receiving the shackles of several padlocks, respectively, and a locking bar slidably mounted on the gate in alignment with the padlock openings as the drum rotates, to facilitate opening the gate after one or more of the padlocks are removed to vacate the padlock openings.

SUMMARY OF THE INVENTION

These and other objects of the invention are provided in a multi-lock latch for securing a gate or closure, which latch includes a rotating drum mounted on the gate, a peripheral flange provided on the rotating drum and spaced holes located in the flange for receiving the respective shackles of multiple padlocks and a locking bar slidably mounted in horizontal orientation on the gate, with the flange-engaging end in alignment with the flange openings as the drum rotates and the opposite, or locking end of the locking bar aligned with an opening provided in a gate post plate located on the gate post. The gate is locked when the locking end of the locking bar is inserted in the plate opening of the gate post plate and the flange-engaging end is spaced from the drum plate flange. The gate can be opened when a padlock shackle is removed from one of the flange openings, the drum and remaining padlocks are rotated to align the vacated opening with the flange-engaging end of the locking bar and the flange-engaging end is slidably registered with the flange opening as the locking end is removed from the plate opening in the gate post plate.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3, 4:
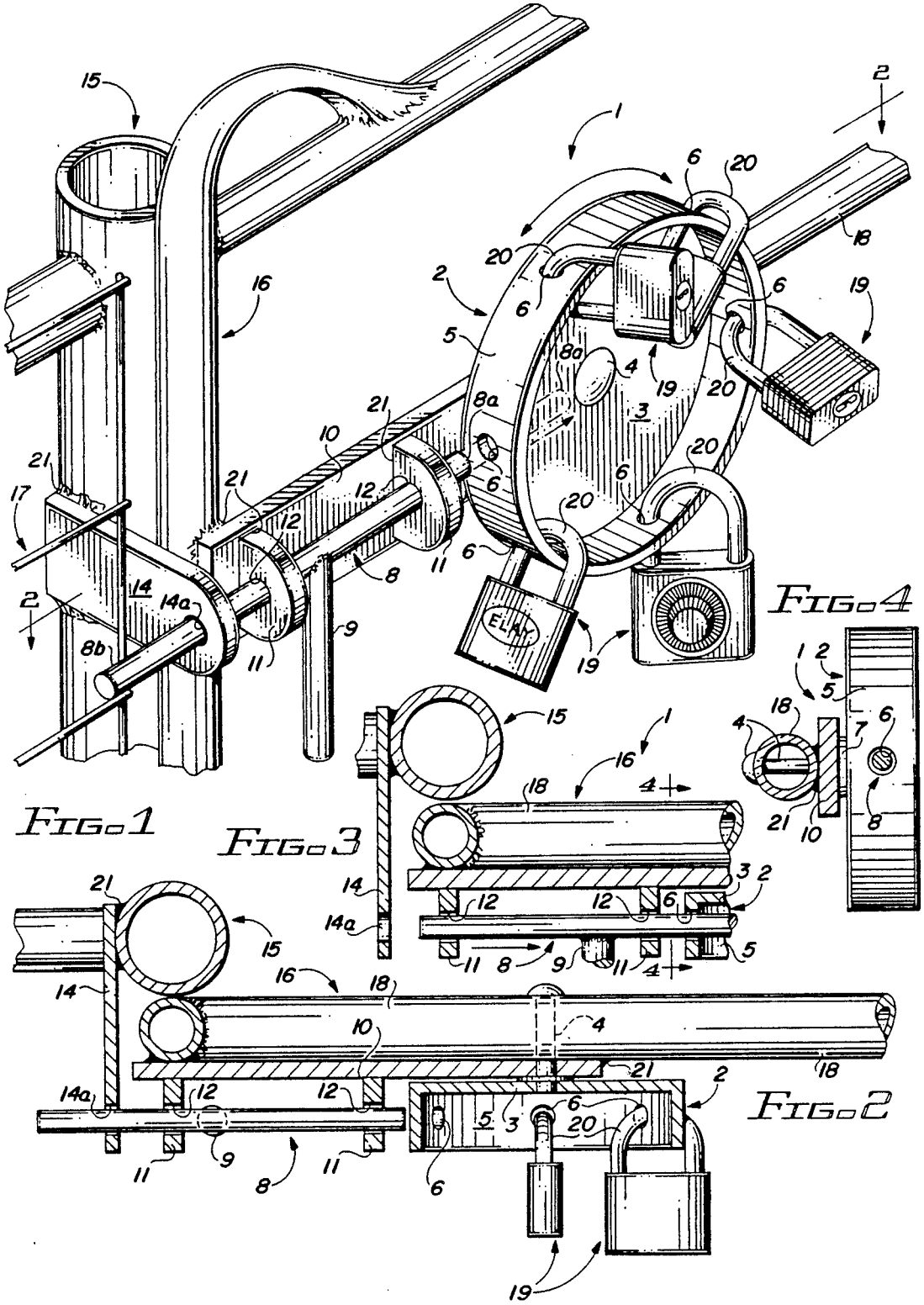
FIG. 1 is a perspective view of the multi-lock latch mounted on a gate in functional, locked configuration.
FIG. 2 is a sectional view taken along line 2—2 of the multi-lock latch illustrated in FIG. 1, with the multi-lock latch disposed in locked configuration.
FIG. 3 is a sectional view of the multi-lock latch illustrated in FIGS. 1 and 2, with the multi-lock latch disposed in locked configuration.
FIG. 4 is a sectional view taken along line 4—4 of the multi-lock latch illustrated in FIG. 3.

Referring initially to FIGS. 1 and 4 of the drawing, the multi-lock latch of this invention is generally illustrated by reference numeral 1. The multi-lock latch 1 includes a round drum 2, characterized by a flat drum plate 3, rotatably secured to a locking bar plate 10, by means of a drum pin 4 and a washer 7. A drum flange 5 extends around the periphery of the drum plate 3 and is provided with multiple, spaced padlock openings 6, for receiving the padlock shackles 20 of multiple padlocks 19, respectively. An elongated locking bar 8 is horizontally oriented in sliding relationship in the flange openings 12 of a pair of spaced plate flanges 11, secured to the locking bar plate 10 by means of welds 21, which locking bar plate 10 is mounted on a gate cross-member 18 of the gate 16, by additional welds 21 or by means of bolts {not illustrated). The flange-engaging end **8*a* of the locking bar 8 is oriented in close proximity to the drum flange 5, whereas the opposite, or locking end 8*b* of the locking bar 8 is extended through the plate opening 14*a* of a gate post plate 14, in order to secure the gate 16 in closed configuration on the gate post 15, which supports the fencing 17**.

Referring now to FIGS. 1–3 of the drawing, when it is desired to open the gate 16 by operation of the multi-lock latch 1, one of the padlocks 19 is unlocked, in order to remove the companion padlock shackle 20 from a corresponding padlock opening 6 in the drum flange 5. The drum 2 is then rotated, along with the remaining padlocks 19, such that the padlock opening 6 vacated by the padlock shackle 20 is aligned with the flange-engaging end **8*a* of the locking bar 8. The locking bar 8 is grasped by the locking bar handle 9 and slidably manipulated toward the drum flange 5, until the flange-engaging end 8*a* registers with the larger padlock opening 6. This maneuver causes the opposite, or locking end 8*b* of the locking bar 8 to vacate the plate opening 14*a* in the gate post plate 14 and facilitates opening of the gate 16 on a pair of gate hinges 17 (not illustrated) at the opposite end of the gate 16**.

It will be appreciated by those skilled in the art that the multi-lock latch of this invention facilitates ingress and egress through the gate 16 by several individuals, each of whom has a key or combination to one of the respective padlocks 19. Accordingly, access can be provided to any desired number of individuals by simply sizing the drum 2 such that the drum flange 5 is sufficiently large in diameter to accommodate the desired number of padlock shackles 20 and padlocks 19. It will be further appreciated by those skilled in the art that although the drum 2 is mounted on the gate 16, it can also be mounted on the gate post 15 along with the locking bar 8, to facilitate locking and unlocking the multi-lock latch 1.

It will also be appreciated that the gate post plate 14 can be eliminated and a horizontal opening may be bored or otherwise provided directly in the gate post 15. This opening can be positioned in alignment with the locking bar 8, in order to receive the locking end **8*b* of the locking bar 8 when the multi-gate latch 1 is in locked configuration. Otherwise, operation of the multi-lock latch 1 is identical to the embodiment described above where the gate post plate 14** is utilized.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A multi-lock latch which utilizes one or more padlocks for opening a gate in a fence, said multi-lock latch comprising drum means rotatably disposed on the gate; at least one drum opening provided in said drum means for receiving the shackle of the padlocks, respectively; locking bar means slidably carried by the gate for alignment with said at least one drum opening responsive to rotation of said drum means, said locking bar means adapted for slidably engaging the fence when the gate is closed, whereby the gate is opened responsive to removal of the shackle from said drum opening, alignment of said drum opening with said locking bar means and slidable manipulation of said locking bar means from the fence into said drum opening.

2. The multi-lock latch of claim 1 wherein said drum means further comprises a round drum plate disposed in a plane parallel to the plane of the gate, a drum pin engaging said plate and secured to the gate for rotatably mounting said plate on the gate and a drum flange provided on the perimeter of said drum plate and wherein said at least one drum opening is located in said drum flange.

3. The multi-lock latch of claim 1 wherein said locking bar means further comprises an elongated locking bar slidably disposed in horizontal orientation on the gate and locking bar mount means mounted on the fence for slidably receiving one end of said locking bar and locking the gate.

4. The multi-lock latch of claim 1 wherein:

(a) said drum means further comprises a round drum plate disposed in a plane parallel to the plane of the gate, a drum pin engaging said plate and secured to the gate for rotatably mounting said plate on the gate and a drum flange provided on the perimeter of said drum plate;

(b) said at least one drum opening is located in said drum flange; and (c) said locking bar means further comprises an elongated locking bar slidably disposed in horizontal orientation on the gate and locking bar mount means mounted on the fence for slidably receiving one end of said locking bar and locking the gate.

5. The multi-lock latch of claim 1 wherein said at least one drum opening further comprises a plurality of drum openings provided in spaced relationship in said drum means for receiving the shackles of a plurality of padlocks, respectively.

6. The multi-lock latch of claim 5 wherein said drum means further comprises a round drum plate disposed in a plane parallel to the plane of the gate, a drum pin engaging said plate and secured to the gate for rotatably mounting said plate on the gate and a drum flange provided on the perimeter of said drum plate and wherein said drum openings are located in said drum flange.

7. The multi-lock latch of claim 5 wherein said locking bar means further comprises an elongated locking bar slidably disposed in horizontal orientation on the gate and locking bar mount means mounted on the fence for slidably receiving one end of said locking bar.

8. The multi-lock latch of claim 5 wherein:

(a) said drum means further comprises a round drum plate disposed in a plane parallel to the plane of the gate, a drum pin engaging said plate and secured to the gate for rotatably mounting said plate on the gate and a drum flange provided on the perimeter of said drum plate;

(b) said drum openings are located in said drum flange; and (c) said locking bar means further comprises an elongated locking bar slidably disposed in horizontal orientation on the gate and locking bar mount means mounted on the fence for slidably receiving one end of said locking bar.

9. The multi-lock latch of claim 1 further comprising a receiving plate attached to a fence post securing the fence and a plate opening provided in said receiving plate, said plate opening oriented in alignment with said locking bar means for selectively slidably receiving one end of said locking bar means and locking the gate.

10. The multi-lock latch of claim 9 wherein said drum means further comprises a round drum plate disposed in a plane parallel to the plane of the gate, a drum pin engaging said plate and secured to the gate for rotatably mounting said plate on the gate and a drum flange provided on the perimeter of said drum plate and wherein said at least one drum opening is located in said drum flange.

11. The multi-lock latch of claim 9 wherein said locking bar means further comprises an elongated locking bar slidably disposed in horizontal orientation on the gate in alignment with said plate opening.

12. The multi-lock latch of claim 9 wherein said at least one drum opening further comprises a plurality of drum openings provided in spaced relationship in said drum means for receiving the shackles of a plurality of padlocks, respectively.

13. The multi-lock latch of claim 9 wherein:

(a) said drum means further comprises a round drum plate disposed in a plane parallel to the plane of the gate, a drum pin engaging said plate and secured to the gate for rotatably mounting said plate on the gate and a drum flange provided on the perimeter of said drum plate;

(b) said at least one drum opening further comprises a plurality of drum openings disposed in spaced relationship in said drum flange for receiving the shackles of a plurality of padlocks, respectively; and (c) said locking bar means further comprises an elongated locking bar disposed in horizontal orientation and locking bar mount means mounted on the fence post for slidably receiving one end of said locking bar.

14. A multi-lock latch which utilizes a plurality of padlocks to secure a gate to a gate post, said multi-lock latch comprising a drum rotatably carried by the gate, said drum having a peripheral flange and spaced flange openings provided in said flange for receiving the shackles of the padlocks, respectively; an elongated locking bar slidably carried by the gate in horizontal orientation, whereby the gate is locked when said locking bar is slidably manipulated with one end of said locking bar engaging the gate post and the gate is unlocked when said locking bar is slidably manipulated with the opposite end of said locking bar extending through one of said flange openings after the shackle of one of the padlocks is removed from said one of said flange openings and said drum is rotated to align said opposite end of said locking bar with said one of said flange openings.

15. The multi-lock latch of claim 14 further comprising a receiving plate attached to the gate post and a plate opening provided in said receiving plate, said plate opening oriented in alignment with said locking bar, for slidably receiving said one end of said locking bar and locking the gate.

16. The multi-lock latch of claim 14 further comprising a handle provided on said locking bar for slidably manipulating said locking bar and selectively locking and unlocking the gate.

17. The multi-lock latch of claim 14 further comprising:

(a) a receiving plate attached to the gate post and a plate opening provided in said receiving plate, said plate opening oriented in alignment with said locking bar for slidably receiving said one end of said locking bar and locking the gate; and (b) a handle provided on said locking bar for slidably manipulating said locking bar and selectively locking and unlocking the gate.

18. The multi-lock latch of claim 14 further comprising a drum pin engaging said drum, said drum pin secured to the gate for rotatably mounting said drum on the gate and a locking bar plate mounted on the gate, said locking bar plate provided with spaced plate flanges and plate flange openings for slidably receiving said locking bar.

19. The multi-lock latch of claim 14 further comprising:

(a) a receiving plate attached to the gate post and a plate opening provided in said receiving plate, said plate opening oriented in alignment with said locking bar for slidably receiving said one end of said locking bar and locking the gate;

(b) a handle provided on said locking bar for slidably manipulating said locking bar and selectively locking and unlocking the gate; and (c) a drum pin engaging said drum, said drum pin secured to the gate for rotatably mounting said drum on the gate and a locking bar plate mounted on the gate, said locking bar plate provided with spaced plate flanges and plate flange openings for slidably receiving said locking bar.

20. A multi-lock latch which utilizes a plurality of padlocks to secure a gate to a gate post terminating a fence, said multi-lock latch comprising a drum rotatably carried by the gate in a plane which is parallel to the plane of the gate, said drum having a peripheral flange and spaced flange openings provided in said flange for receiving the shackles of the padlocks, respectively; an elongated locking bar slidably carried by the gate in horizontal orientation; and a receiving plate attached to the gate post and a plate opening provided in said receiving plate, said plate opening oriented in alignment with said locking bar for selectively receiving one end of said locking bar and locking the gate, whereby the gate is locked when said locking bar is slidably manipulated with said one end engaging said receiving plate in the gate post and the gate is unlocked when said locking bar is slidably manipulated with the opposite end thereof extending into one of said flange openings after the shackle of one of the padlocks is removed from said one of said flange openings and said drum is rotated to align said opposite end of said locking bar with said one of said flange openings.

* * * * *